US011641892B2

(12) United States Patent
Moss

(10) Patent No.: US 11,641,892 B2
(45) Date of Patent: May 9, 2023

(54) SAFETY WEAR ITEM

(71) Applicant: Kevin Moss, Rochester Hills, MI (US)

(72) Inventor: Kevin Moss, Rochester Hills, MI (US)

( * ) Notice: Subject to any disclaimer, the term of this patent is extended or adjusted under 35 U.S.C. 154(b) by 0 days.

(21) Appl. No.: 17/567,239

(22) Filed: Jan. 3, 2022

(65) Prior Publication Data

US 2022/0279871 A1 Sep. 8, 2022
US 2022/0279871 A1 Sep. 8, 2022

Related U.S. Application Data

(60) Provisional application No. 63/155,843, filed on Mar. 3, 2021.

(51) Int. Cl.
*A41D 13/01* (2006.01)
*A41D 1/04* (2006.01)

(52) U.S. Cl.
CPC ..... *A41D 13/01* (2013.01); *A41D 1/04* (2013.01)

(58) Field of Classification Search
CPC ..... A41D 13/01; A41D 1/04; F21V 33/006
See application file for complete search history.

(56) References Cited

U.S. PATENT DOCUMENTS 10,856,589 B1 * 12/2020 Lee ..... A41D 13/01
2008/0043458 A1 * 2/2008 Desjardin ..... G08B 5/004 362/108
2015/0016095 A1 * 1/2015 Kretzu ..... A41D 13/01 362/108

* cited by examiner

*Primary Examiner* — Thomas M Sember
(74) *Attorney, Agent, or Firm* — John R. Benefiel

(57) ABSTRACT

A safety wear item featuring a series of LEDs mounted on each of four separate mounting strips, two strips extending down from a respective one of the wear item shoulders and two other strips wrapped around each side of the lower region of a wear item waist. The strips with LEDs are each readily and quickly detachable from the wear item to allow washing the vest or to replace a strip having a defective LED thereon.

1 Claim, 3 Drawing Sheets

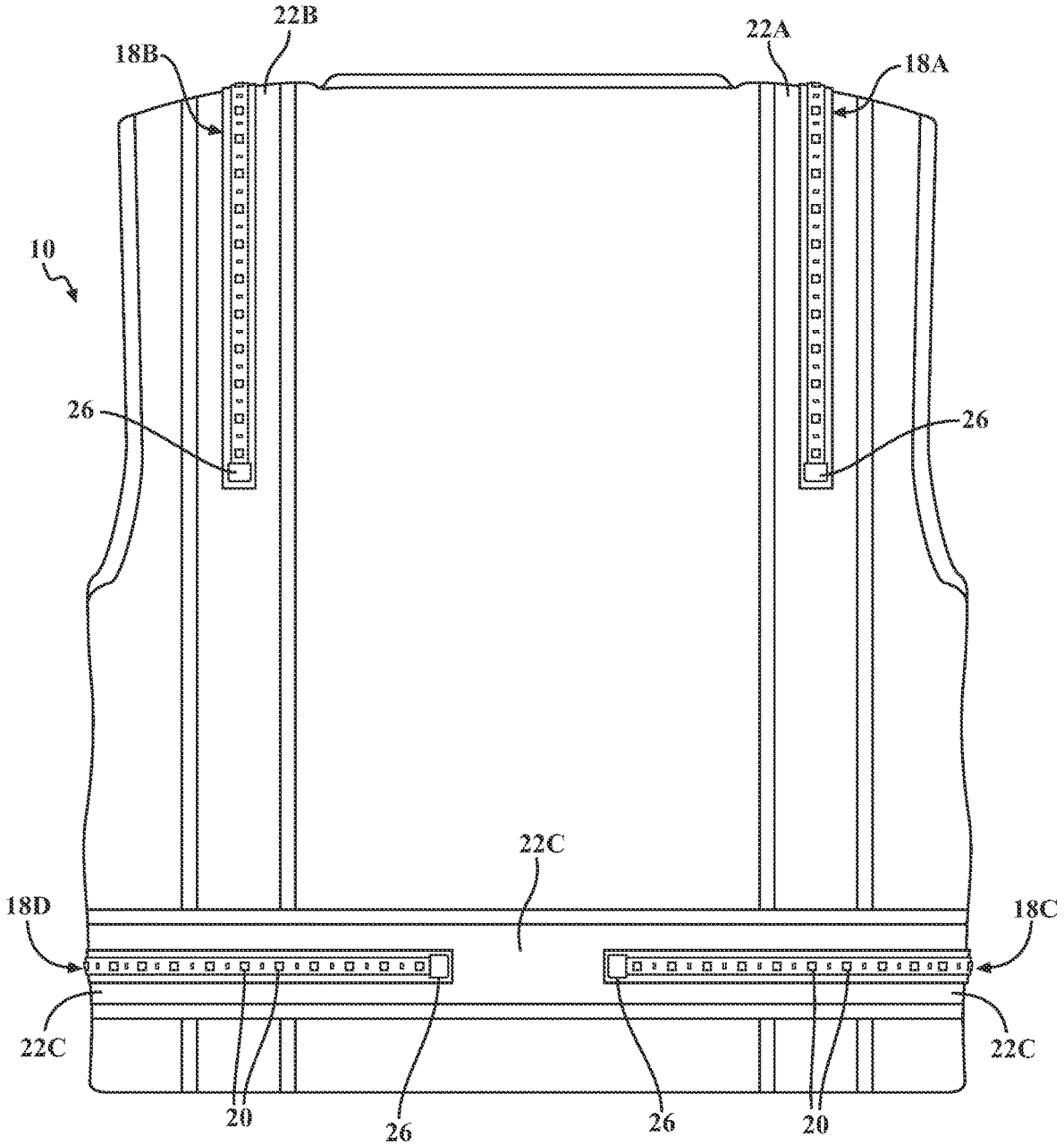
FIG. 2A
FIG. 2B
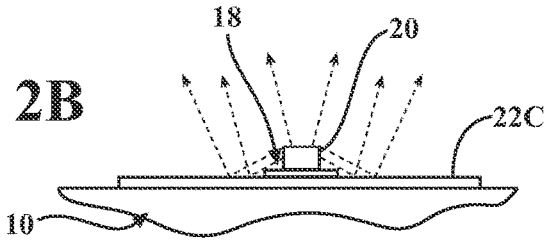

SAFETY WEAR ITEM

CROSS REFERENCE TO RELATED APPLICATIONS

This application claims the benefit of U.S. provisional patent application No. 63/155,843 filed on Mar. 3, 2021.

BACKGROUND OF THE INVENTION

This application concerns safety wear items such as vests or sets of straps of a type that have lights such as LEDs mounted thereon so as to make a wearer much more visible to an onlooker in low light conditions.

This situation arises in the context of preventing injuries to hunters, construction workers, etc., in low light conditions due to a failure of someone to realize that another person is present, who could be injured by the activity of that someone. For example, while hunters commonly wear bright clothing, this may not help in low light conditions. As a result, a hunter could discharge his firearm in the direction of a person who is not seen by the hunter.

Such safety wear item are currently available, but those items have significant limitations which are sought to be eliminated by the present invention.

Reference is made to U.S. Pat. No. 6,106,130, which shows a set of straps having a series of LEDs thereon which lie flat on the wearer's back and chest having opposite ends adapted to be attached to a belt worn by a user.

One limitation is that it is time consuming to remove all of the LEDs particularly one after the other in order to wash the safety wear item.

It is also inconvenient to remove and replace all of the LEDs if this is necessary to replace one or more of the LEDs.

It is an object of the present invention to enable convenient and rapid removal of lights on wear to replace failed LEDs or to wash the safety wear after removal of the LEDs.

SUMMARY OF THE INVENTION

The present invention comprises a safety wear item such as a vest having several elongated strips which each have a series of LED lights secured along the length thereof.

Each of the strips are mounted thereon by an easily detachable means (such as by a hook and loop fastening such as Velcro™) from the wear item and to a wider reflective strap mounted on the wear item so that all of the LEDs can be removed quickly.

Each strip is separately mounted to the reflective tape by a connection which is readily detachable and reattachable.

This allows quick and convenient removal and replacement of one or more of the strips having a series of LED lights thereon so as to allow washing the wear item, or replacement of a strip having a defective LED by detaching any strip having a failed LED and replacing the same with a strip in which all of the LED's are working. Only a fraction of the LEDs needs to be removed and that fraction are all removed together so that it can be quickly accomplished.

DESCRIPTION OF THE DRAWINGS

FIG. 2A is a rear view of the safety vest shown in FIG. 1.

FIG. 2B is an end view of one of the strips shown in the Figures with a representation of reflected light beams.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
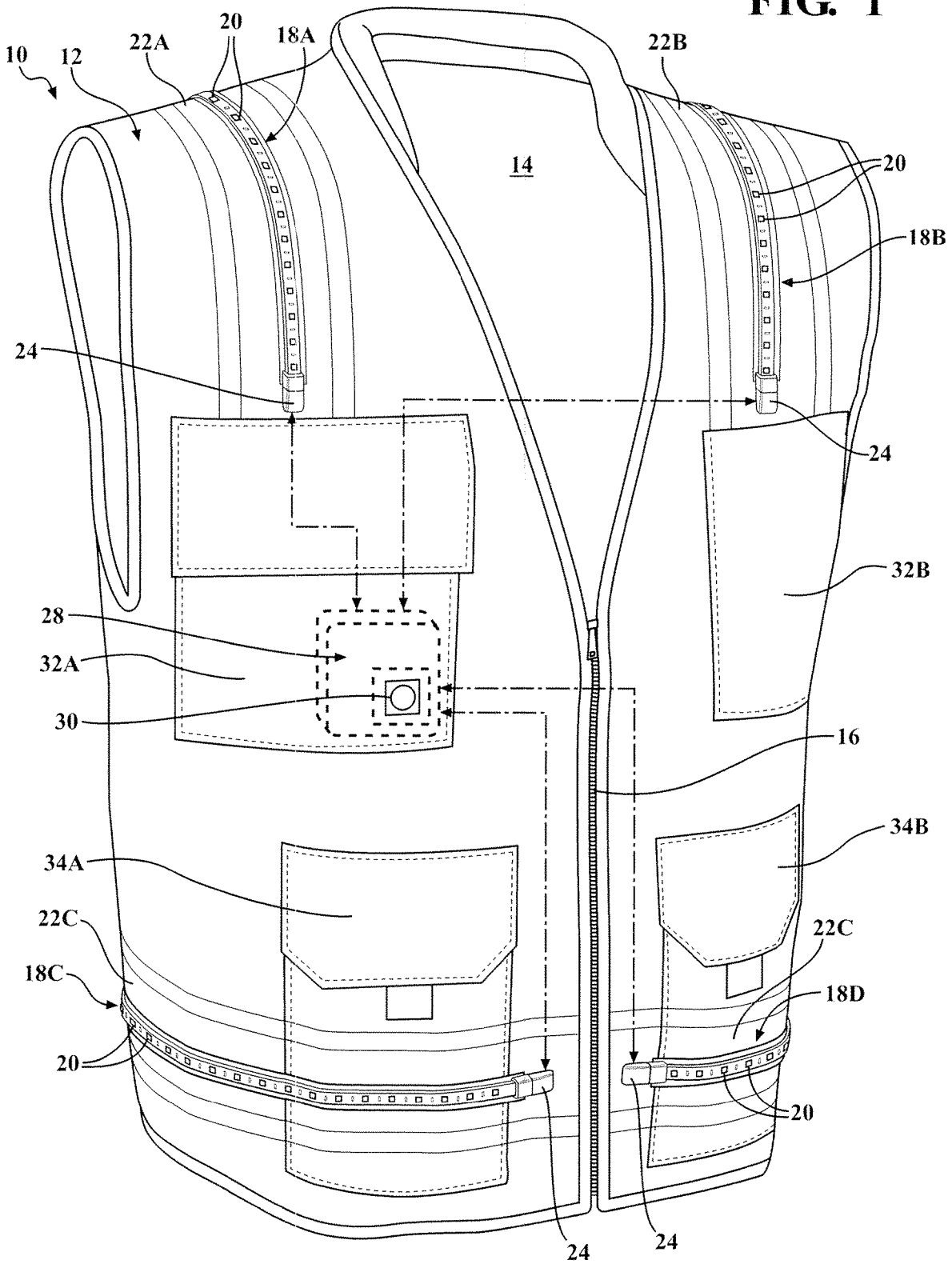
FIG. 1 is a perspective front view of a safety vest according to the invention.
Figure 3:
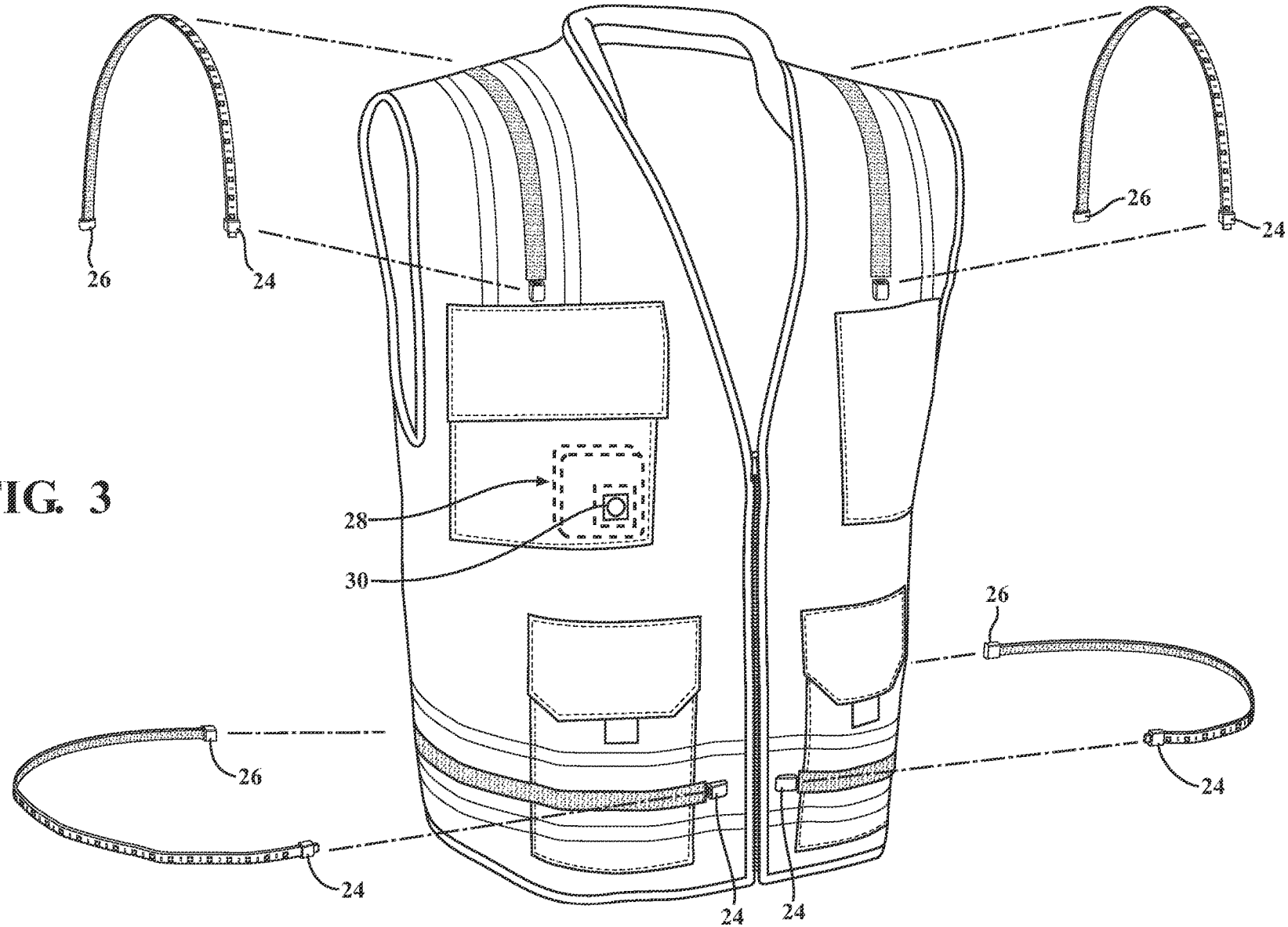
FIG. 3 is an exploded view of all of the strips mounting LEDs on the safety vest.

Referring to the drawings, and particularly FIG. 1, a safety wear item such as a safety vest 10 according to the invention is shown, which is comprised of a sleeveless vest type garment 12 which has a neck opening 14 tapering down the front thereof to a zipper 16 which may allow opening the front to facilitate putting the vest 12 on and taking it off in a conventional manner.

In the present embodiment, as seen in FIG. 1 there are four separate LED mounting flexible strips 18A, 18B, 18C and 18D, two strips are each wrapped around the top of the left and right sides of a shoulder portion of the safety vest 10 and vertically down the back and the front of the vest. Two other strips 18C and 18D extend horizontally around the right and left side of the vest 10 adjacent the bottom of the vest 10.

Each flexible strip 18A-18D has a number of spaced apart LEDs 20 fixedly mounted thereon.

Each strip 18A-18D is mounted atop a length of a reflective tape 22A-22B extending vertically around an upper side of respective sides of the safety vest 10, while tape 22C extend horizontally completely around a bottom region of the vest 10.

It should be understood that the circuitry used to energize the LEDs is entirely contained within the strips 18A-18D, which is a standard practice control for energizing the LEDs 20. That is, electricity from a rechargeable battery 28 is applied to one end of each of the strips 18A-18D by a connector 24 and a conductor 26 at the other end redirects the electricity when switch 30 is operated back down each of the strips 18A-18D to the other pole of the battery 28 so as to complete the circuit which powers the LEDs. The battery 28 is contained in an upper pocket 32 with the switch 30 protruding out through one side of the upper pocket 32A to be conveniently accessible. The LED strips 18A-18B and tapes 18C-18D extend over the respective lower pockets 34A and 34B.

This technique also has been used to energize only some of the LEDs cooperating with a switch in such applications on cars to enable use as turning signals or brake lights by energizing only some of the LEDs 20 in a series by a controller (not shown) contained in the strips 18A, 18B, 18C and 18D.

The invention claimed is:

1. A safety wear item comprising a vest in which at least four strips are separately mounted to said vest, each of said separate strip segments of strips having a series of LEDs attached along the length thereof, two of said strip segments of a length to extend over a respective shoulder portion of said vest and partially down the front and the back portion of said vest; and two other of said strips extending horizontally only partially around a respective lower side of said vest also having two conductors connected together at one end by a connection and to said battery at the other end whereby LEDs are visible to onlookers to the front or the back, or to the right or to the left of the vest;

a battery mounted in a pocket at the front of said vest; each strip connected at a front end to said battery; each strip having a conductor at a back end connecting together separate conductors which are both connected at one end to each other and both connected to said battery at their other ends connected together by an electrical connection and other ends to said battery; and a switch connected to said conductors and said battery, said battery and switch located at the approximate middle of the height of said vest; said vest having an upper vee shaped opening able to allow a wearer's head to be passed through said opening;

a zipper extending about half way up a bottom of said vest able to be unzipped to facilitate putting said vest on and off of a wearer; and a pair of pockets on either side of said zipper.

* * * * *